United States Patent [19]

Schuhmacher

[11] 4,348,945

[45] Sep. 14, 1982

[54] DEVICE FOR CONTROLLING A HYDRAULIC POWER CIRCUIT

[75] Inventor: Werner Schuhmacher, Aspergs, Fed. Rep. of Germany

[73] Assignee: Robert Bosch GmbH, Stuttgart, Fed. Rep. of Germany

[21] Appl. No.: 167,230

[22] Filed: Jul. 10, 1980

Related U.S. Application Data

[63] Continuation of Ser. No. 928,412, Jul. 16, 1978, abandoned.

[30] Foreign Application Priority Data

Aug. 20, 1977 [DE] Fed. Rep. of Germany ..... 2737653

[51] Int. Cl.[3] ..... F15B 13/042; F16K 31/143

[52] U.S. Cl. ..... 91/452; 91/418; 91/449; 137/596.12; 251/25; 251/334

[58] Field of Search ..... 137/596.12, 596.13; 91/449, 452, 418; 60/494; 251/25, 135, 334

[56] References Cited

U.S. PATENT DOCUMENTS

| | | | |
|---|---|---|---|
| 3,370,613 | 2/1968 | Weaver | 137/625.69 |
| 3,985,153 | 10/1976 | Thomas | 137/596.12 X |
| 4,069,746 | 1/1978 | Schwerin et al. | 60/494 X |

FOREIGN PATENT DOCUMENTS

| | | | |
|---|---|---|---|
| 1928896 | 11/1970 | Fed. Rep. of Germany . | |
| 2034214 | 1/1972 | Fed. Rep. of Germany | 91/452 |

*Primary Examiner*—Irwin C. Cohen
*Attorney, Agent, or Firm*—Michael J. Striker

[57] ABSTRACT

The control device is applicable as a hydraulic regulating valve for controlling a power lift unit of a tractor and comprises a mechanically actuated preliminary selector valve operable for reciprocal movement to close or open pressure fluid supply into a control chamber counteracting a reciprocal main pressure control valve that is spring loaded against the control chamber. To avoid permanent choking resulting from pressure changes due to the movement of the control edges, a section of the preliminary control slide is recessed to such an extent as to exert elastic extension when subject to increased pressure, the extension being within the limits of elasticity of the material of the slide.

6 Claims, 3 Drawing Figures

DEVICE FOR CONTROLLING A HYDRAULIC POWER CIRCUIT

This is a continuation of application Ser. No. 928,412, filed July 16, 1978, now abandoned.

BACKGROUND OF THE INVENTION

This invention relates generally to a device for controlling hydraulic working circuits and, more specifically, it relates to a control device that is applicable as a travel regulating valve for controlling a hydraulic power lift unit in a tractor. The device is of the type where a mechanically actuated slide of a preselector valve cooperates with a slide of a main selector valve that in response to the position of the preselector slide resumes a neutral position or an operative position. In the neutral position the main selector valve brings the supplied pressure fluid into a non-pressurized circulation whereas in the operative position the flow resistance in the non-pressurized circuit is increased and the pressure is applied to the load.

Hydraulic control devices of this type are known, for example from the German Pat. No. 1,928,896 and include besides the preselector valve slide and the main valve slide an auxiliary slide that is arranged in an axial boring of the main valve slide. In this known control device the auxiliary slide contributes to the pressure relief of a control chamber arranged in the main control slide. This prior art device is supposed to prevent by means of jumping movement of the auxiliary slider the occurrence of such a choking action in which an amount of pressure oil delivered by the pump is capable of leaking over the pressure relieving openings when pressure conditions have correspondingly increased so that the pump has to operate at an unduly increased pressure. This choking action or process, called "tight choking", may very quickly result in breakdown of the pump. However, in the prior art control devices the tight-choking is avoided during the pressure building phase that means during the displacement of the slider of the preselector valve from the neutral position to a lifting position, but there still remains the possibility that during the displacement of the preselector slider from working or lifting position to the neutral position pressure conditions may result that can induce the tight choking effect. Moreover, the known control device has the disadvantage that the tolerances and mutual arrangement of ports and control edges in the borings and on the slides of the valve, are critical. Above all, the prior art control device has the disadvantage that it is very expensive because in addition to the auxiliary slide there are necessary additional control shoulders, ports and control openings for diminishing the danger of tight choking.

SUMMARY OF THE INVENTION

It is therefore an object of this invention to avoid the disadvantages of prior art control devices of this type.

More particularly, it is an object of the invention to provide an improved control device for hydraulic power circuits that are simple and compact in structure.

Another object of the invention is to provide an improved control device that eliminates the additional auxiliary slider with corresponding opening, ports and control shoulders that hitherto had been necessary for preventing the tight choking effect.

A further object of the invention is to provide means that make it possible to improve existing control devices without difficulties and with minimum cost.

An additional object of this invention is to provide such an improved control device that prevents the tight choking effect not only during the movement from the neutral position to the operative position but also during the movement of the preselector slide from lifting or working position in the direction to neutral position.

Furthermore, an object of this invention is to provide an improved control device in which the tolerances and complexity of control edges and ports is relatively easy to be mastered from the production point of view.

In keeping with these objects, and others which will become apparent hereafter, one feature of the invention resides, in a control device of the aforementioned type, in a combination which comprises means for avoiding the tight choking effect resulting from pressure changes in a control chamber when changing the position of a preselector valve, the means including a recessed section provided on the preselector slide in the range of the control chamber and defining lateral end faces that are subject to pressure changes in the control chamber and a bottom portion the cross section of which is reduced to such an extent as to exert elastic extension in longitudinal direction when the end faces are subject to increased pressure, thereby completing the closing of the passage between the control chamber and a pressure chamber of the main selector valve.

In a preferred embodiment, the end faces in the recess on the preselector slide that are subject to effective pressure changes, have equal surfaces. The slide of the main selector valve is arranged for movement within a blind boring in the slide of the preselector valve whereby the pressure chamber for the main valve results between the end surface of the blind bore and the end surface of the main slide. The bottom portion in the recess of the preselector slide is arranged in the range of movement of the main selector slide and is provided with openings that connect the control chamber with pressure relief spaces. The preselector slide is coupled to a mechanical control linkage by means of which either the neutral or the working position of the selector valve system can be adjusted. Preferably, the preselector slide is provided with a second recess extending between the first mentioned control edge and a second control edge that provides an adjustable passage between the pressure chamber for the main selector valve and a pressure relief space. In the coaxial arrangement of the preselector slide and main selector slide, the length of the elastically extensible bottom portion of the recess in the preselector slide equals preferably to the diameter of this recessed portion and the wall thickness of the bottom portion equals preferably one-third of the wall thickness of the remaining portions of the preselector slide. The second recessed part of the preselector slide is dimensioned so as to register with an opposite shoulder in the valve boring when the preselected slide is brought to a working position of the device. The device of this invention is applicable as a regulating device for controlling a servo motor in an agricultural machine such as a tractor or a harvester thresher.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
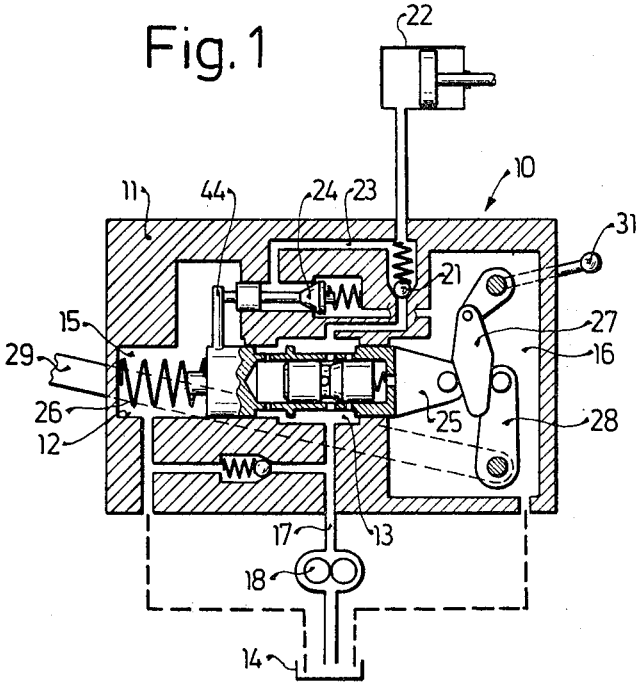
FIG. 1 is a longitudinal section of a schematic representation of a control device in its neutral position.
Figure 2:
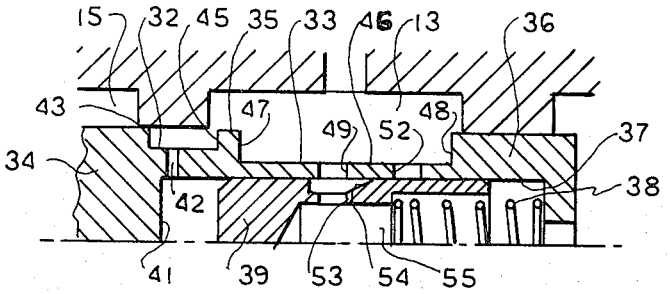
FIG. 2 is a sectional cut-away view of a part of the device of FIG. 1 showing the preselector slide in the beginning of its lift position.

FIGS. 1 and 2 show a control device 10 having a housing 11, a boring 12 for accommodating a preselector slide 25. The end portions of the boring 12 communicate respectively with pressure relieving spaces 15 and 16 connected to pressure oil tank 14 and the central part of the boring 12 is extended in diameter to form an annular chamber 13. The chamber 13 communicates with pressure fluid supply pipe 17 through which a pressure medium from pump 18 is delivered into the chamber and further it communicates via working pipe line and via a non-return valve 21 with a hydraulic power lift unit 22 that can be relieved through a return pipe line 23 connected through lowering control valve 24 to a pressure relief space 16. The preliminary control or preselector slide 25 is urged by means of a pressure spring 26 arranged in the pressure relieving space 15 into slidable contact with a setting member 27 that at the other side is in slidable contact with a lever 28 controlled by a regulating rod 29. The position of the setting member 27 and thus the position of the slide 25 is mechanically adjustable by means of lever 31. As shown in more detail in FIG. 2, the preselector slide 25 is provided with two annular grooves 32 and 33 dividing the slide surface into three separate sections 34, 35 and 36. The preselector slide 25 has an axial blind boring 37 which accommodates for sliding movement a main selector slide 39 that is also provided with an axial blind boring 55. The main selector slide 39 extends approximately between the second sector 35 and the third sector 36 and the remainder of the blind boring 37 between the first sector 34 and the end surface of the main selector slide 39 defines a control chamber 41. The control chamber 41 communicates through a port 42 with the first annular groove 32 of the preselector slide. The end surfaces of the first annular groove 32 define with respective sectors 34 and 35 control edges 43 and 45 that cooperate with correspondingly spaced control edges resulting in the boring 12 between pressure relief space 15 and pressure chamber 13. If the preselector slide 25 is moved to the left, the first control edge 43 is out of register with the wall of pressure relief space 15 and creates an adjustable passage connecting the control chamber 41 through the port 42, the first annular groove 32 to the pressure relieving space 15. The movement of the preselector slide 25 is transmitted to the control valve 24 for lowering the lift unit 22 by means of a pin 44 connecting the slide 25 to the valve 24. The second sector 35 of the slide 25 defines as mentioned above a second control edge 45 that provides for an adjustable passage connecting the first annular groove 32 with the pressure chamber 13. The second sector of the slide 25 is relatively narrow so that the second annular groove 33 in the preselector slide 25 extends over the major part of the pressure chamber 13. The second annular groove 33 is deeper than the first annular groove and the thickness of its bottom wall 46 extending between lateral end surfaces 47 and 48 is selected so as to be extendable within elastic limits of the material of the preselector piston 25. In other words, the second groove 33 reduces the diameter of the slide 25 to such an extent that the narrow wall portion between the bottom 46 of the groove 33 and the inner wall formed by the axial boring 37 exhibits perceptible changes in its longitudinal direction when pressure changes take place in the pressure chamber 13 during the operation of the device. These changes in longitudinal direction remain however within the elastic limits of the material of the slide 25. In order to still increase these elastic changes in longitudinal direction, an opening is made in the bottom wall 46 so that the mass of the bottom wall is additionally reduced. The opening 52 and the passage 49 is controlled by the main selector slide 39 as it will be explained below. The main selector 39 is provided with an opening 53 communicating with the interior blind boring 55 and the upper part of the opening 53 is increased in diameter and provided with a sloping control edge 54. The inner blind boring 55 in which the pressure spring 38 partially projects, communicates with the pressure relieving space 16 so that it relieves pressure from the pressure chamber 13. Since the second surface sector 35 of the slide 25 is made relatively narrow, the length of the bottom section 46 of the groove 33 is relatively long and exceeds the diameter of the preselector slide 25 in the range of this section. As it has been explained above, the first control edge 43 and the second control edge 45 formed by end walls of the first annular groove 32 are designed so as to register with corresponding end surfaces of the flange in the housing 11.

The operation of the control device is as follows:

The position of the preselector slide 25 as illustrated in FIG. 1 corresponds to neutral position of the control device 10 during which pressure fluid supplied by the pump 18 flows through supply conduit 17, pressure chamber 13, passage 49 in the preselector valve 25 and the opening 53 in the main selector valve 39 into the blind boring 55 and therefrom through the pressure relieving space 16 into the tank 14. During this neutral circulation the control edge 54 in the upper part of the opening 53 in the main selector valve 39 chokes the relatively small pressure in the chamber 13 resulting from the neutral circulation of the pressure fluid. Through the open passage between the control edge 45 and the end surface of the pressure chamber 13, the pressure fluid enters through port 42 into control chamber 41 where it acts against the force of the spring 38 and keeps the main selector slide 39 in its open position as illustrated in FIG. 2. In this open position the pump 18 provides an almost unloaded circulation of the pressure fluid.

Figure 3:
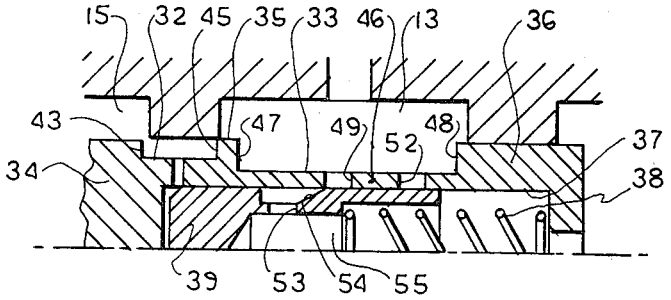
FIG. 3 is a sectional cut-away view of a part of the device of FIG. 1 showing the preselector slide in the end of its lift position.

If it is desired to lift the power lift unit 22, the lever 31 is operated counterclockwise so that the preselector slide 25 is moved to the left to the position as shown in FIG. 3. This position is attained also in the case of a lowering load (for example due to oil leakage) so that the control rod 29 is mechanically moved to the left and via lever 28 moves the slide 25 also to the left. In this position, the control edges 43 and 45 close the communication to the first annular groove 32 since they are in register with the assigned end surfaces of the opposite flange in the housing 11. In this aligned position of the control edges, the danger of the so-called tight choking exists. The tight choking means an equilibrium condition at which the main selector valve 39 chokes the otherwise nonpressurized circulation of the pressure fluid with a more or less increased effect so that the pump 18 has to deliver the entire stream of fluid against the correspondingly increased pressure in the return circuit and this overloading may cause a fast breakdown of the pump. In the event of the tight choking, pressure fluid leaks over the closed control edges 43 and 45 in such a quantity that the main valve 39 may resume a position at which it completely chokes up the circulation of the pressure fluid. In the device of this invention, the pressure increase resulting in the pressure chamber 13 at the beginning of the tight choking condition acts against the end surfaces 47 and 48 in the annular groove 33 in the slide 25 and causes, within the limits of elastic deformability of the material of the slide 25, the axial extension of the thin wall bottom section in the groove 33. It is important that this axial extension takes place only then when the controlling process has been initiated. The extension brings about only a further displacement of the first control edge 43 in the opening direction relative to the registering end face of the shoulder in the housing 11 and the displacement of the second controlling edge 45 in the closing direction relative to the assigned stationary end surfaces of the housing. In this manner a relatively large improvement of the operation of the selector valve system is attained and the occurrence of the tight choking is reliably eliminated. By designing a relatively long bottom part 46 of the second annular groove 33, a correspondingly increased extension of the thin wall bottom 46 can be achieved. The elastic extension can be increased by making additional material cutouts 51 thus increasing the stretchability of the material within its limits of elastic deformability.

The same result, namely the elimination of the tight choking is achieved when the preselector slide 25 is moved from the lifting or working position in the direction to the neutral position whereby it moves past the position as illustrated in FIG. 2. In doing so, the decreasing pressure in the pressure chamber 13 causes the contraction of the section 46 in the second annular groove 33 and in a reversed order the control edge 43 more firmly closes the passage between the first annular groove 32 and the pressure relieving space 15 and the second control edge 45 is moved in the direction of the neutral position so that the neutral position is reached without the occurrence of the tight choking effect. For lowering the hydraulic power lift unit 22 is relieved in usual manner by means of the lowering valve 24.

The invention as described above in the preferred embodiment makes it possible to construct a simple and compact hydraulic control device that eliminates the danger of the tight choking effect. It will be understood that each of the elements described above, or two or more together, may also find a useful application in other types of constructions differing from the types described above.

While the invention has been illustrated and described as embodied in a control device employing a coaxial arrangement of the preselector slide and the main selector slide, it is not intended to be limited to the details shown, since various modifications and structural changes may be made without departing in any way from the spirit of the present invention. For example, the inventive idea is applicable in a construction using spatially separate preselector slide and main selector slide. In another possible modification instead of the second control edge 45 it is possible to use a choking passage for limiting the pressure fluid flow into the control chamber 41.

What is claimed as new and desired to be protected by Letters Patent is set forth in the appended claims:

1. In a control device for hydraulic unit power circuit having a fluid supply source, a combination comprising a housing having a boring; a preselector valve arranged for reciprocating movement within said boring between a working position and a neutral position, opposite ends of said preselector valve being open to a pressure relieving space means; first spring means biasing said preselector valve within said housing, said housing defining within said boring a recessed pressure chamber and a control section associated therewith and having first and second control edges spaced apart from each other for a predetermined distance, said pressure chamber being associated with a pressure fluid supply conduit and with a working conduit, said preselector valve having a blind boring defining an annulus and being formed with a first annular groove having third and fourth control edges at each end thereof corresponding to the first-mentioned control edges, respectively and a second annular groove arranged within the range of said pressure chamber, said preselector valve having a bore for communicating said first groove with said blind boring, said second and fourth control edges being adjacent said recessed pressure chamber and said first and third control edges being adjacent said pressure relieving space means; a main selector valve arranged within said blind boring of the preselector valve for slidable movement therein; second spring means biasing said main selector valve, said main selector valve having an axial opening adapted to be connected to said pressure relieving space means in said housing; a first radial channel formed in said preselector valve between said second groove and said main selector valve; and a second radial channel formed in said main selector valve between said preselector valve and said axial opening of the main selector valve, said first radial channel being out of register with said second radial channel when said preselector valve is in working position to permit a working fluid to flow to said working conduit, and being in register with said second radial channel when said preselector valve is in neutral position to permit the working fluid to flow to said pressure relieving space means, said fourth control edge being in overlapping relation with said second control edge and said third control edge being spaced relative to said first control edge when the preselector valve is in working position, said third control edge being in overlapping relation with said first control edge and said fourth control edge being spaced relative to said second control edge when the preselector valve is in neutral position, said second radial groove having a thin annular bottom portion forming a part of said annulas and lateral end pressure responsive surfaces being so dimensioned as to produce extension and contraction of said bottom portion in axial direction within the limits of elastic deformability of a material of said preselector valve in response to pressure changes in said pressure chamber, said extension causing relative axial displacement and increased overlapping of said second and fourth control edges in the working position to prevent a tight choking.

2. A combination as defined in claim 1 wherein said lateral end surfaces in said second annular groove are equal in area.

3. A combination as defined in claim 2 wherein said elastically extendable and contractable bottom part of said second annular groove is provided with additional openings for reducing the mass of said bottom portion.

4. A combination as defined in claim 1 further including a servo-motor for use in an agricultural machine such as a tractor or a harvester thresher, said working conduit being operatively coupled to said servomotor.

5. A combination as defined in claim 1 wherein the thickness of the wall of said bottom portion in said second annular groove corresponds approximately to one third of the thickness of the wall of said preselector slide in the region of said third and fourth control edges.

6. A combination as defined in claim 1 wherein a surface section of said preselector valve defined between said first annular groove and said second annular groove is substantially shorter than said second annular groove.

* * * * *